US005832348A

United States Patent [19]

Rankin

[11] Patent Number: 5,832,348

[45] Date of Patent: Nov. 3, 1998

[54] MATERIAL DISPENSING APPARATUS

[75] Inventor: William Rankin, Dublin, Ireland

[73] Assignee: Faircove Systems, Dublin, Ireland

[21] Appl. No.: 793,265

[22] PCT Filed: Aug. 23, 1995

[86] PCT No.: PCT/IE95/00043

§ 371 Date: May 2, 1997

§ 102(e) Date: May 2, 1997

[87] PCT Pub. No.: WO96/06385

PCT Pub. Date: Feb. 29, 1996

(Under 37 CFR 1.47)

[30] Foreign Application Priority Data

Aug. 23, 1994 [IE] Ireland ..... S940660

[51] Int. Cl.[6] ..... G03G 15/08

[52] U.S. Cl. ..... 399/260; 399/258; 222/413; 141/18; 141/44

[58] Field of Search ..... 399/258, 260, 399/262; 141/18, 44, 59, 73, 80, 317; 222/412, 413

[56] References Cited

U.S. PATENT DOCUMENTS

| | | | |
|---|---|---|---|
| 2,783,703 | 3/1957 | Brown | 141/59 X |
| 3,386,372 | 6/1968 | Knipp | 141/73 X |
| 4,833,501 | 5/1989 | Buyukguclu | 399/261 |
| 5,443,102 | 8/1995 | Svendsen | 141/73 X |
| 5,711,215 | 1/1998 | Sextl et al. | 141/73 X |
| 5,711,353 | 1/1998 | Ichikawa et al. | 141/73 X |

OTHER PUBLICATIONS

Author: Boellman, Shari; Title: "Leading Ladies," The Recycler, pp. 26–27; Date of Publication: After Mar. 1994; Place of Publication: Unknown.

PER–FIL Industries manufacturers' literature concerning PER–FIL Model PF–MR–1 Micro Recharger; Date and Place of Publication: Unknown.

*Primary Examiner*—Matthew S. Smith

*Attorney, Agent, or Firm*—Hoffman & Baron, LLP

[57] ABSTRACT

An apparatus for dispensing fine particulate material includes a hopper for storing material to be dispensed, a discharge tube having a discharge nozzle and an auger for feeding stored material from the hopper to the discharge tube. The fine particulate material is regulated by a meter which meters the amount transferred by the auger to the discharge tube. Material is transferred to a container to be charged by positioning it against the discharge nozzle so that the auger transfers a predetermined amount of material from the hopper to the discharge tube. Material laden displaced air from the container escapes into a settling tube where the material in the displaced air is allowed to settle and fall by gravity into the container.

10 Claims, 2 Drawing Sheets

MATERIAL DISPENSING APPARATUS

BACKGROUND OF THE INVENTION

1. Field of the Invention

The present invention relates to a dispensing apparatus and more particularly relates to an apparatus for dispensing fine particulate material such as toner for photocopiers and laser printers. "Toner" is a term used in reprographics to describe the electrostatic compound that acts as the "ink" forming the image on a plain-paper copy.

2. Description of the Prior Art

Fine particulate material is known to be difficult to handle in automated processes. This is particularly true where the material is to be passed from one container to another. Where material is passed from one container to another, displaced air carries with it a certain amount of the fine material. This arrangement is often unsatisfactory as it creates a particle-laden atmosphere which may be hazardous to breathe. Additionally, accumulated material may effect machinery and may be difficult to clean.

In a known semi-automated process such as that exemplified by Per-Fil apparatus (Per-Fil Industries, Inc. Riverside, N.J. 08075, U.S.A.), fine particulate material is dispensed from a storage hopper into cartridges for use. The material is toner for laser printers, photocopiers and the like, and is used for charging cartridges which fit specific machines. The dispensing apparatus is required to meter out a predetermined amount of toner into a range of sizes of toner cartridge and comprises a hopper, a vertically disposed auger and a dispensing nozzle. In this filling process, the empty cartridge is held under the dispensing to feed the required amount of material to the nozzle. The displaced air carries with it a quantity of toner. Additionally, due to the liquid-like flow of fine particulate material, the amount of toner dispensed from the auger may vary unacceptably.

SUMMARY OF THE INVENTION

It is a object of the present invention to seek to alleviate the above disadvantages and to provide an improved dispensing apparatus for fine particulate material such as toner.

Accordingly, the present invention provides an apparatus for dispensing fine particulate material comprising:

a hopper for storing material to be dispensed;

a discharge tube having a discharge nozzle;

a generally horizontally disposed feeding means for transferring stored material from the hopper to the discharge tube;

a fine particulate material metering means for regulating the amount of material transferred by the feeding means to the discharge tube;

a settling tube; and biasing means operable to urge a container to be charged with material into sealing engagement with the discharge nozzle, whereby in use the container is sealed against the discharge nozzle, the feeding means transfers a predetermined amount of material from the hopper to the discharge tube and material laden displaced air from the container escapes into the settling tube where the material in the displaced air settles and falls by gravity into the container Preferably, the feeding means comprises a generally horizontally disposed auger.

Advantageously, the auger is arranged so that the particulate material carried therethrough is biased to remain in the auger or to return to the hopper, whereby flow of the material ceases when the auger stops.

Conveniently, the metering means comprises a timer based switching means to regulate the number of revolutions of the auger so that the material through-feed is accurately and consistently metered.

In a preferred embodiment, the discharge tube and the settling tube form part of a vertically disposed tube which is fed by the auger at a junction located remote from the tube's upper end. The material falls from the junction to the discharge nozzle at the lower end of the tube and displaced air escapes upwardly via the discharge tube to the settling tube where the material carried by the displaced air is allowed to settle and fall under gravity into the container juxtaposed the discharge nozzle.

Advantageously, the container is sealed against the discharge nozzle by a plate having the biasing means.

Conveniently, the discharge nozzle has a tapered profile to facilitate sealing engagement with a range of container charging apertures.

Preferably, a means is included for agitating the material in the hopper.

Advantageously, the agitating means is driven from the feeding means.

The apparatus preferably comprises a single hopper (23) and a plurality of feeding means (25) and associated discharge tubes.

The invention will now be described more particularly with reference to the accompanying drawings which show, by way of example only, one embodiment of dispensing apparatus according to the invention.

DESCRIPTION OF THE PREFERRED EMBODIMENTS

Figure 1:
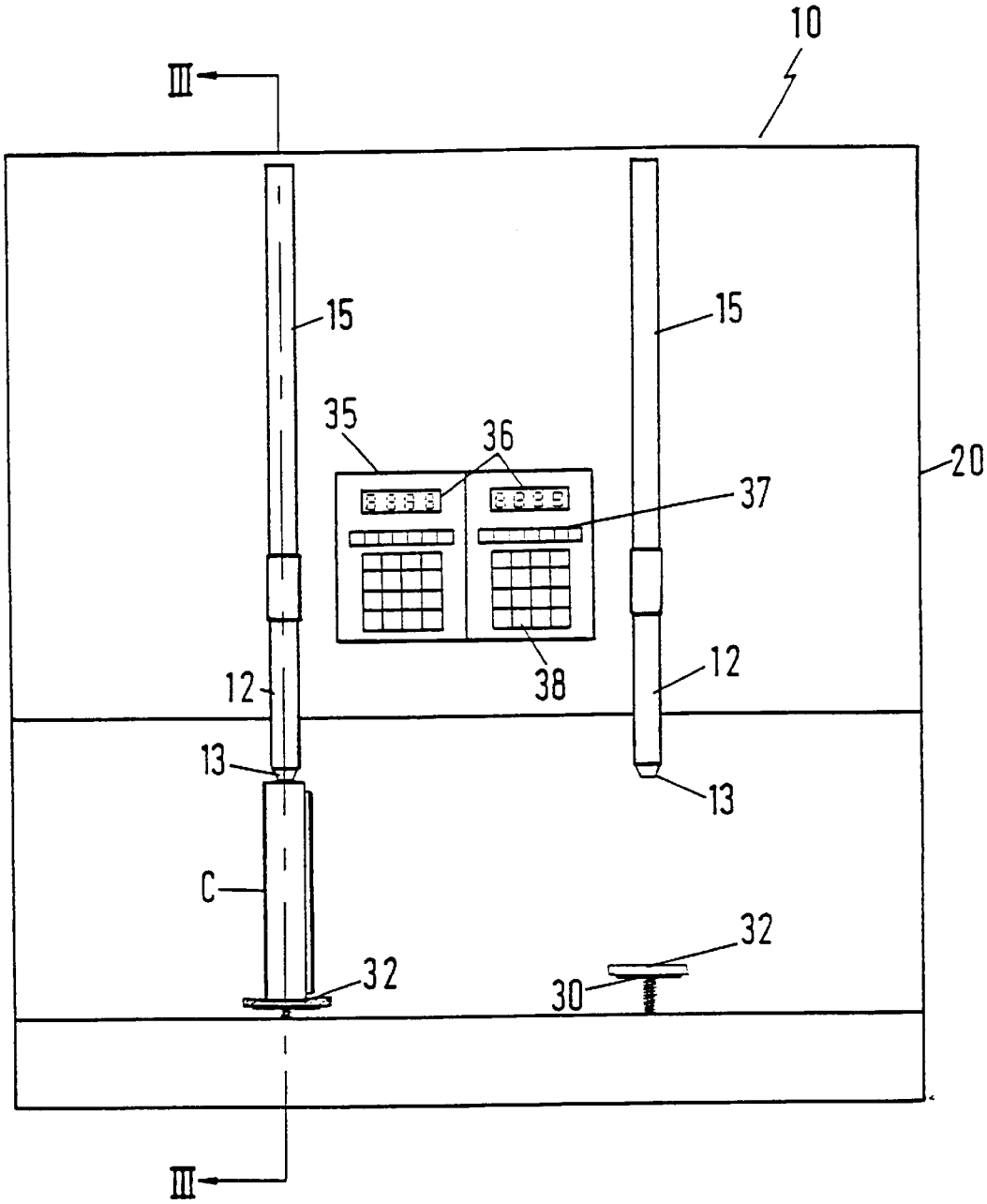
FIG. 1 is a front elevation of the dispensing apparatus.
Figure 2:
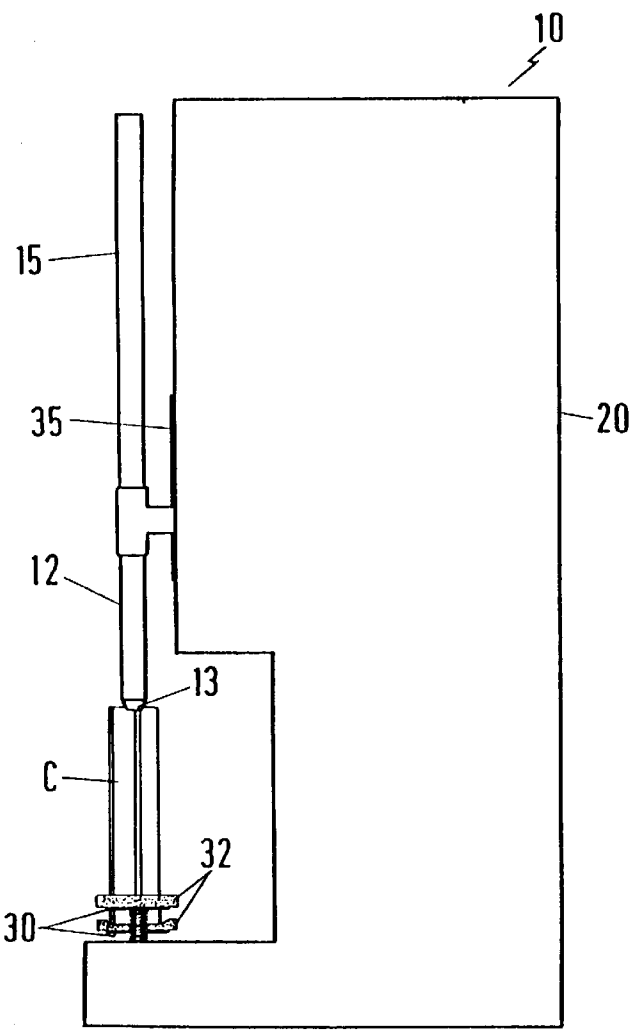
FIG. 2 is a side elevation of the dispensing apparatus.

Referring to the drawings and initially to FIGS. 1 and 2, a dispensing apparatus 10 has two dispensing outlets each comprising a dispensing tube 12 having a dispensing nozzle 13 thereon. Above each dispensing tube 12 is a settling tube 15 which is open-ended to allow air to escape.

Figure 3:
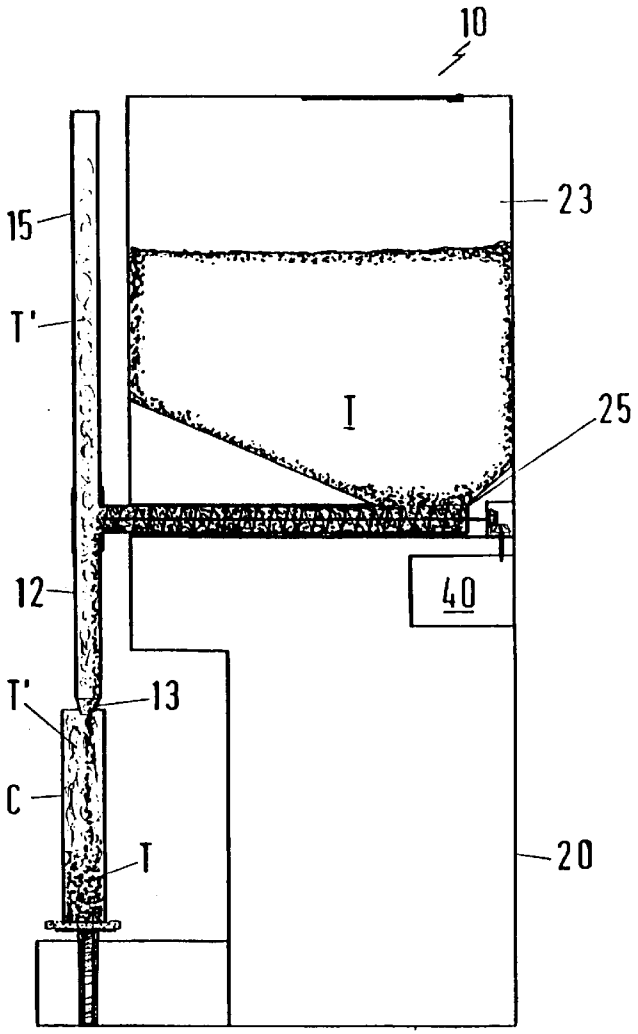
FIG. 3 is a sectional side elevation of the apparatus taken along lines III—III of FIG. 1.

The apparatus 10 further comprises a housing 20 which contains a hopper 23 and an auger 25 for each dispensing outlet, as shown in detail in FIG. 3. In use a toner cartridge C which is to be charged with toner T is placed on a spring biased plate 30. The plate has a foam pad 32 to protect the cartridge C from accidental damage. The cartridge C has a charging aperture which is brought into engagement with the dispensing nozzle 13 which has a tapered profile to provide substantially sealed contact between the nozzle and the cartridge charging aperture. A control panel 35 is provided for each dispensing outlet. Each control panel 35 has an LED or LCD display 36, preprogrammable function keys 37 and numerical input keys 38. When a cartridge C is to be charged, the user selects a function from the panel 35 and presses one of the corresponding keys 37,38. A motor 40 rotates the auger 25 at a constant speed for a period determined by the selected input. As the auger 25 rotates, toner T from the hopper 23 is fed along the auger 25 until it drops under gravity into the dispensing tube 12. The toner T flows through the nozzle 13 and into the cartridge C. As the cartridge C fills with toner T, displaced air is forced back through the nozzle 13. The displaced air carries with it fine particles of toner T' which travel upwardly through the dispensing tube 12 into the settling tube 15. As the displaced air becomes less turbulent the toner particles T' begin to settle and fall back into the dispensing tube 12. The substantially clean displaced air escapes through the open top of the settling tube 15.

The spring biased plates 30 and the tapered profile of the dispensing nozzle 13 allow a range of cartridges C to be charged. Cartridges with large or small capacities can be accurately filled to prespecified weights by activating the auger 25 for a period corresponding proportionally to the required weight or volume of toner required.

Accuracy of the amounts of toner dispensed is dependent on the constant speed rotation of the auger 25 for precisely controlled periods and is also dependent on the orientation of the auger 25. As the auger is horizontally disposed, once the auger stops rotating toner supply to the dispensing tube ceases. If, as in the prior art, the dispensing end of the auger is significantly lower than the hopper feed end of the auger then toner flow characteristics affect the accuracy as when the auger stops rotating, toner flow continues in a random manner for a short period. In an alternative embodiment of the present invention, the dispensing end of the auger is significantly higher than the hopper feed end. This embodiment (not shown) allows a greater hopper storage capacity and preserves the accuracy of material dispensed.

Although the present invention is directed towards a dispensing apparatus for toner for use in printers such as laser printers and in photocopiers, it will be seen that the apparatus is suitable for dispensing any fine particulate material.

An agitator (not shown) is optionally provided in the hopper 23 to prevent "clumping" of the toner T. The agitator is powered either directly from the auger 25 or from the motor 40.

The embodiment of the present invention may be adapted for user in a modular form whereby banks of dispensing apparatus may be assembled.

It will of course be understood that the invention is not limited to the specific details described herein, which are given by way of example only, and that various modifications and alterations are possible within the scope of the appended claims.

What is claimed is:

1. An apparatus for dispensing fine particulate material comprising:

a hopper for storing material to be dispensed;

a discharge tube having a discharge nozzle;

a generally horizontally disposed feeding means for transferring stored material from the hopper to the discharge tube;

a fine particulate material metering means for regulating the amount of material transferred by the feeding means to the discharge tube;

a settling tube; and biasing means operable to urge a container to be charged with material into sealing engagement with the discharge nozzle, whereby in use the container is sealed against the discharge nozzle, the feeding means transfers a predetermined amount of material from the hopper to the discharge tube and material laden displaced air from the container escapes into the settling tube where the material in the displaced air settles and falls by gravity into the container.

2. A dispensing apparatus as claimed in claim 1, in which the feeding means comprises a generally horizontally disposed auger.

3. A dispensing apparatus as claimed in claim 2, in which the auger is arranged so that the particulate material carried therethrough is biased to remain in the auger or to return to the hopper, whereby flow of the material ceases when the auger stops.

4. A dispensing apparatus as claimed in claim 2, in which the metering means comprises a timer based switching means to regulate the number of revolutions of the auger so that the material through-feed is accurately and consistently metered.

5. A dispensing apparatus as claimed in claim 2, in which the discharge tube and the settling tube form part of a vertically disposed tube which is fed by the auger at a junction located remote from the tube's upper end.

6. A dispensing apparatus as claimed in claim 1, in which the container is sealed against the discharge nozzle by a plate having the biasing means.

7. A dispensing apparatus as claimed in claim 1, in which the discharge nozzle has a tapered profile to facilitate sealing engagement with a range of container charging apertures.

8. A dispensing apparatus as claimed in claim 1, which includes a means for agitating the material in the hopper.

9. A dispensing apparatus as claimed in claim 8, in which the agitating means is driven from the feeding means.

10. A dispensing apparatus as claimed in claim 1, comprising a single hopper and a plurality of feeding means and associated discharge tubes.

* * * * *